US010126105B2

(12) United States Patent
Lemke et al.

(10) Patent No.: US 10,126,105 B2
(45) Date of Patent: Nov. 13, 2018

(54) PROJECTILES FOR AMMUNITION AND METHODS OF MAKING AND USING THE SAME

(71) Applicants: Paul Lemke, Savannah, GA (US); Juan Carlos Marin, Ripoll (ES); Steven Eric Johnson, Gibbon, NE (US)

(72) Inventors: Paul Lemke, Savannah, GA (US); Juan Carlos Marin, Ripoll (ES); Steven Eric Johnson, Gibbon, NE (US)

(73) Assignee: Quantum Ammunition, LLC, Savannah, GA (US)

( * ) Notice: Subject to any disclaimer, the term of this patent is extended or adjusted under 35 U.S.C. 154(b) by 0 days.

(21) Appl. No.: 15/668,732

(22) Filed: Aug. 4, 2017

(65) Prior Publication Data

US 2018/0045496 A1 Feb. 15, 2018

Related U.S. Application Data

(62) Division of application No. 15/023,477, filed as application No. PCT/US2014/057171 on Sep. 24, 2014, now Pat. No. 9,841,260.

(30) Foreign Application Priority Data

Sep. 24, 2013 (ES) ..... 201331387

(51) Int. Cl.

| | |
|---|---|
| ***F42B 10/24*** | (2006.01) |
| ***F42B 12/74*** | (2006.01) |
| ***F42B 12/76*** | (2006.01) |
| *F42B 6/10* | (2006.01) |

(52) U.S. Cl.
CPC ..... *F42B 10/24* (2013.01); *F42B 12/74* (2013.01); *F42B 12/76* (2013.01); *F42B 6/10* (2013.01)

(58) Field of Classification Search
CPC ..... F42B 10/22; F42B 10/24
See application file for complete search history.

(56) References Cited

U.S. PATENT DOCUMENTS

| | | | | | |
|---|---|---|---|---|---|
| 463,922 | A | * | 11/1891 | Russell | F42B 10/24 244/3.23 |
| 1,373,322 | A | * | 3/1921 | Freitas | F42B 10/22 244/3.23 |
| 1,596,180 | A | * | 8/1926 | Henderson | F42B 10/24 102/499 |
| 2,356,227 | A | * | 8/1944 | Diehl | F42B 10/22 102/519 |

(Continued)

FOREIGN PATENT DOCUMENTS

| | | | |
|---|---|---|---|
| DE | 16742 | C | * 6/1881 |
| DE | 563931 | C | * 1/1931 |

(Continued)

OTHER PUBLICATIONS

Machine translation of DE 563931, Espacenet (Year: 1932).*

*Primary Examiner* — Stephen Johnson
*Assistant Examiner* — Joshua T Semick
(74) *Attorney, Agent, or Firm* — Withers & Keys, LLC

(57) ABSTRACT

Projectiles for ammunition and ammunition for firearms are disclosed. Methods of making projectiles for ammunition and ammunition for firearms, and methods of using projectiles for ammunition and ammunition for firearms are also disclosed.

20 Claims, 6 Drawing Sheets

(56) References Cited

U.S. PATENT DOCUMENTS

| | | | | | |
|---|---|---|---|---|---|
| 4,655,140 | A * | 4/1987 | Schirneker | ..... | F42B 10/22<br>102/508 |
| 5,133,261 | A * | 7/1992 | Kelsey, Jr. | ..... | F42B 10/22<br>102/439 |
| 6,070,532 | A * | 6/2000 | Halverson | ..... | F42B 14/02<br>102/501 |
| 8,443,730 | B2 * | 5/2013 | Padgett | ..... | F42B 5/313<br>102/466 |
| 2007/0151474 | A1 * | 7/2007 | Widener | ..... | F42B 10/24<br>102/501 |

FOREIGN PATENT DOCUMENTS

| | | | | | |
|---|---|---|---|---|---|
| DE | 563931 | C * | 11/1932 | ..... | F42B 10/22 |
| FR | 807118 | A * | 9/1935 | | |

* cited by examiner

PROJECTILES FOR AMMUNITION AND METHODS OF MAKING AND USING THE SAME

This patent application is a divisional patent application of U.S. Utility patent application Ser. No. 15/023,477 entitled "PROJECTILES FOR AMMUNITION AND METHODS OF MAKING AND USING THE SAME" filed on Mar. 21, 2016, now U.S. Pat. No. 9,683,818, which is the national stage patent application of PCT International Patent Application No. PCT/US2014/057171, filed on 24 Sep. 2014, and claiming priority to Spanish Provisional Patent Application Serial No. P201331387, filed on 24 Sep. 2013, the contents of all of which is incorporated herein by reference in its entirety.

FIELD OF THE INVENTION

The present invention relates to projectiles for ammunition, and ammunition for firearms. The present invention also relates to methods of making projectiles for ammunition and methods of using projectiles for ammunition.

BACKGROUND OF THE INVENTION

Metal and non-metal (i.e., polymeric) projectiles are known. For example, U.S. Pat. No. 5,237,930 (Belanger et al.) discloses projectiles comprising a thermoplastic material (i.e., polyamide) matrix filled with copper powder. The resulting "frangible projectiles" possess (1) similar ballistic effects as conventional projectiles, and (2) the ability to disintegrate upon impact with a hard surface.

Using a similar powder metallurgy concept, U.S. Pat. No. 6,074,454 (Abrams et al.) and U.S. Pat. No. 6,090,178 (Benini) proposed to make a similar projectile, but used only metal powder without any kind of polymeric binder, sintered by itself.

Furthermore, U.S. Pat. No. 6,149,705 (Lowden et al.) and U.S. Pat. No. 6,263,798 (Benini) disclosed applying a powder metallurgical manufacturing concept projectile again, by joining metal powder together via another metal, as a binder, with lower melting temperature, in an attempt to emulate the original work of Belanger et al. without sintering and without non-metallic material processing.

Finally, U.S. Pat. No. 6,546,875 (Vaughn et al.) disclosed a design and manufacturing method of a hollow-point projectile without using lead. The disclosed design included a hollow tip made of monolithic tin in combination with a powder metallurgic component around the monolithic tin to give weight to the projectile with all comprised in a coating of copper or brass.

In view of prior projectile developments, the present inventors continued efforts to develop projectiles with the goal of developing a projectile (e.g., metal and/or non-metal) that would harness both the kinetic and rotational energy imparted on the projectile in the process of firing. The development took into account: (1) the material(s) used to form the projectile, knowing that, in some cases (e.g., a polymer filled with metal particles), the material(s) would be relatively light and the resulting projectile would travel at a higher velocity and spin much faster than conventional bullets; (2) velocity and revolutions per minute (or second) of the resulting projectile; (3) the ability of the projectile shape to disrupt soft tissue even when using lower than normal bullet mass; (4) the need for the bullet to be able to be fed reliably into a wide variety of firearms on the market (e.g., pistols, air guns, rifles, machine guns, etc.); (5) the target accuracy of the resulting projectile upon firing from a weapon, and the development of correct projectile diameters and base configurations to deliver peak accuracy; and (6) barrel wear on the firearm due to the projectile design/materials.

SUMMARY OF THE INVENTION

The present invention addresses some of the difficulties and problems discussed above by the discovery of new projectiles and ammunition containing projectiles. The projectiles (e.g., metal and/or non-metal) of the present invention enable the production of ammunition that provides one or more of the following benefits: (1) a tough, durable bullet that easily penetrates soft tissue, but may remain frangible (or non-frangible) on steel targets; (2) utilizes the different forms of projectile energy, i.e., kinetic and rotational, upon exiting a firearm barrel so as to transfer an optimum amount of energy to soft tissue; (3) maintains a shape that results in essentially 100% reliability with regard to feeding into a firearm; (4) results in a minimum amount of fouling even at high velocities; (5) results in a minimum amount of undue wear to the throat or barrel of firearms; (6) displays exceptional accuracy upon firing; and, in some case, (7) is about 30% lighter than conventional bullets, which translates into lower shipping costs, higher velocities and less recoil.

Accordingly, in one exemplary embodiment, the present invention is directed to projectiles for ammunition. In some exemplary embodiments, the projectile for ammunition comprises an outer profile geometry on an ogive-shaped impact end portion thereof, said outer profile geometry comprising two or more notches extending in at least one of (i) an axial, (ii) parallel or (iii) slightly inclined orientation relative to a dissecting axis extending longitudinally through said impact end portion of said projectile, wherein each notch (a) comprises notch surface portions so as to increase (i) an overall outer surface area of said ogive end portion of projectile, and (ii) a given length of an outer surface periphery extending along a line within a plane normal to said dissecting axis, and (b) is surrounded by an outer side surface of said ogive-shaped impact end portion of said projectile.

In some exemplary embodiments, the projectile for ammunition comprises an outer surface profile extending along an ogive-shaped impact end portion of said projectile; and two or more notches extending axially along said outer surface profile, wherein each notch: (a) comprises notch surface portions so as to increase (i) an overall outer surface area of said ogive end portion of projectile, and (ii) a given length of an outer surface periphery extending along a line within a plane normal to said dissecting axis, (b) is surrounded by an outer side surface of said ogive-shaped impact end portion of said projectile; (c) comprises a notch dissecting line extending axially through and being centrally located within said notch, (d) comprises notch outer periphery points along an outer notch perimeter on opposite sides of said notch dissecting line, and (e) comprises right and left-hand line portions of a normal line extending from said notch dissecting line to each notch outer periphery point, wherein each of said right and left-hand line portions (i) increases in length along at least a first portion of said notch dissecting line and subsequently (ii) decreases in length along at least a second portion of said notch dissecting line extending between an uppermost periphery portion of said notch and a lowermost periphery portion of said notch.

In some exemplary embodiments, the projectile for ammunition comprises an outer surface profile extending along an ogive-shaped impact end portion of said projectile; and two or more notches extending axially along said outer surface profile, wherein each notch: (a) comprises notch surface portions so as to increase (i) an overall outer surface area of said ogive end portion of projectile, and (ii) a given length of an outer surface periphery extending along a line within a plane normal to said dissecting axis, (b) is surrounded by an outer side surface of said ogive-shaped impact end portion of said projectile; (c) comprises a notch depth dissecting line extending axially through and being located along a path that represents a largest depth within said notch, (d) comprises notch outer periphery points along an outer notch perimeter on opposite sides of said notch depth dissecting line, and (e) comprises right and left-hand line portions of a normal line extending from said notch depth dissecting line to each notch outer periphery point, wherein each of said right and left-hand line portions (i) increases in length along at least a first portion of said notch depth dissecting line and subsequently (ii) decreases in length along at least a second portion of said notch depth dissecting line extending between an uppermost periphery portion of said notch and a lowermost periphery portion of said notch.

In some embodiments, the present invention is directed to projectiles formed from polymeric material loaded with copper, which possess the property of fragmentation after impact on hard surfaces, with an external geometry that increases penetration effectiveness on soft surfaces, increasing the terminal effects of the penetration. Further, the disclosed projectiles can have an overall geometry for proper use of the projectile with polymer casings, composite casings, and/or metal casings.

The present invention is even further directed to methods of making projectiles for ammunition. In some exemplary embodiments, the method of making a projectile for ammunition comprises at least one of: (i) injection molding a plastic material filled with metal particles, (ii) sintering and/or (iii) machining so as to from any of the herein-described projectiles.

In some exemplary embodiments, the method of making a projectile for ammunition comprises forming any one of the herein-described projectiles, said forming step selected from any one or any combination of: (i) a molding step, (ii) a stamping step, (iii) a machining step, (iv) a pressure-applying step, and (v) a striking step.

In some exemplary embodiments, the method of making a projectile for ammunition comprises forming a projectile, wherein the projectile comprises an outer profile geometry on an ogive-shaped impact end portion thereof, said outer profile geometry comprising two or more notches extending in at least one of (i) an axial, (ii) parallel or (iii) slightly inclined orientation relative to a dissecting axis extending longitudinally through said impact end portion of said projectile, wherein each notch (a) comprises notch surface portions so as to increase (i) an overall outer surface area of said ogive end portion of projectile, and (ii) a given length of an outer surface periphery extending along a line within a plane normal to said dissecting axis, and (b) is surrounded by an outer side surface of said ogive-shaped impact end portion of said projectile.

In some exemplary embodiments, the method of making a projectile for ammunition comprises forming a projectile, wherein the projectile comprises an outer surface profile extending along an ogive-shaped impact end portion of said projectile; and two or more notches extending axially along said outer surface profile, wherein each notch: (a) comprises notch surface portions so as to increase (i) an overall outer surface area of said ogive end portion of projectile, and (ii) a given length of an outer surface periphery extending along a line within a plane normal to said dissecting axis, (b) is surrounded by an outer side surface of said ogive-shaped impact end portion of said projectile; (c) comprises a notch dissecting line extending axially through and being centrally located within said notch, (d) comprises notch outer periphery points along an outer notch perimeter on opposite sides of said notch dissecting line, and (e) comprises right and left-hand line portions of a normal line extending from said notch dissecting line to each notch outer periphery point, wherein each of said right and left-hand line portions (i) increases in length along at least a first portion of said notch dissecting line and subsequently (ii) decreases in length along at least a second portion of said notch dissecting line extending between an uppermost periphery portion of said notch and a lowermost periphery portion of said notch.

In some exemplary embodiments, the method of making a projectile for ammunition comprises forming a projectile, wherein the projectile comprises an outer surface profile extending along an ogive-shaped impact end portion of said projectile; and two or more notches extending axially along said outer surface profile, wherein each notch: (a) comprises notch surface portions so as to increase (i) an overall outer surface area of said ogive end portion of projectile, and (ii) a given length of an outer surface periphery extending along a line within a plane normal to said dissecting axis, (b) is surrounded by an outer side surface of said ogive-shaped impact end portion of said projectile; (c) comprises a notch depth dissecting line extending axially through and being located along a path that represents a largest depth within said notch, (d) comprises notch outer periphery points along an outer notch perimeter on opposite sides of said notch depth dissecting line, and (e) comprises right and left-hand line portions of a normal line extending from said notch depth dissecting line to each notch outer periphery point, wherein each of said right and left-hand line portions (i) increases in length along at least a first portion of said notch depth dissecting line and subsequently (ii) decreases in length along at least a second portion of said notch depth dissecting line extending between an uppermost periphery portion of said notch and a lowermost periphery portion of said notch.

The present invention is even further directed to a method of using projectiles for ammunition. In one exemplary embodiment, the method of using a projectile for ammunition comprises: positioning a composite or polymer or metal casing comprising any one of the herein-described projectiles in a chamber of a projectile-firing weapon; and firing the weapon. In some embodiments, the projectile-firing weapon comprises a pistol or any other type of hand gun. In other embodiments, the projectile-firing weapon comprises a rifle or any other type of long gun. In other embodiments, the projectile-firing weapon comprises a machine gun or submachine gun.

These and other features and advantages of the present invention will become apparent after a review of the following detailed description of the disclosed embodiments and the appended claims.

DETAILED DESCRIPTION OF THE INVENTION

To promote an understanding of the principles of the present invention, descriptions of specific embodiments of the invention follow and specific language is used to describe the specific embodiments. It will nevertheless be understood that no limitation of the scope of the invention is intended by the use of specific language. Alterations, further modifications, and such further applications of the principles of the present invention discussed are contemplated as would normally occur to one ordinarily skilled in the art to which the invention pertains.

The present invention is directed to projectiles for ammunition, and ammunition for firearms. The present invention is further directed to methods of making projectiles for ammunition, and ammunition for firearms. The present invention is even further directed to methods of using projectiles for ammunition, and ammunition for firearms.

Figure 1:
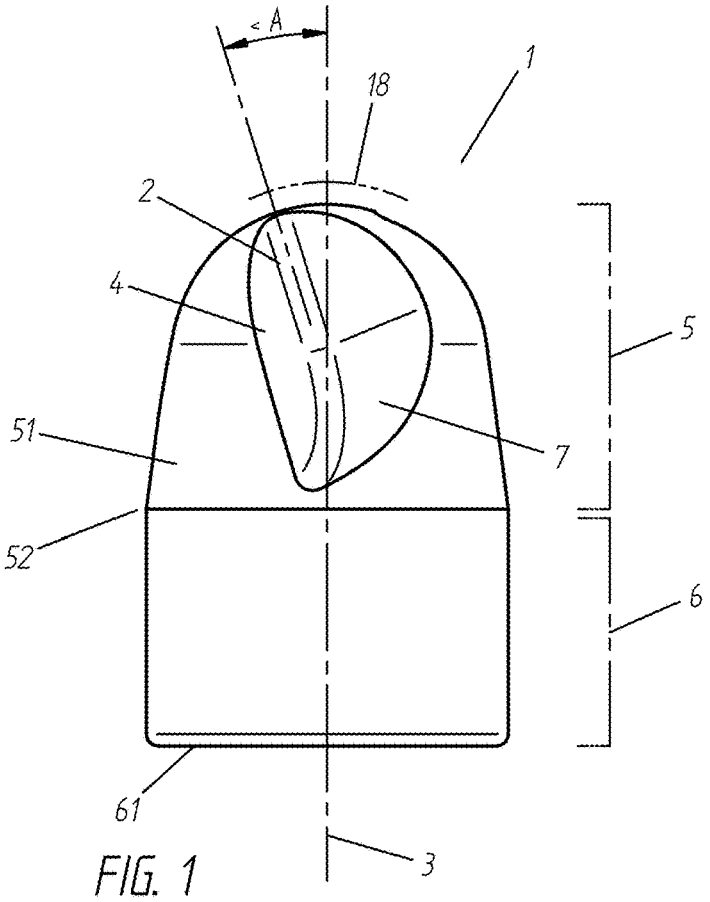
FIG. 1 depicts a front view of an exemplary projectile for ammunition of the present invention.
Figure 3:
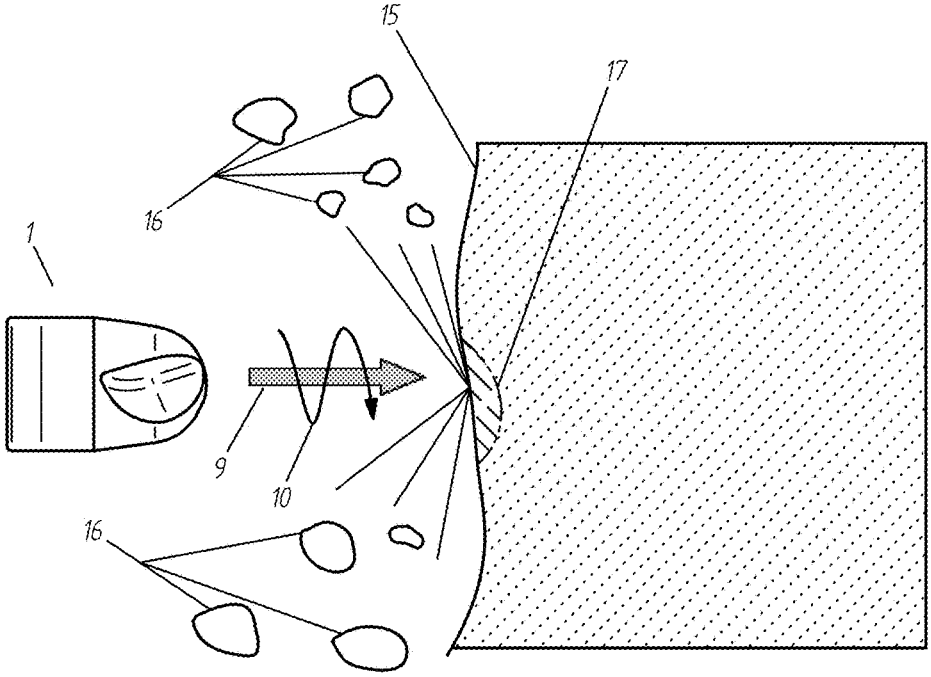
FIG. 3 depicts the effect of the impact of the exemplary projectile shown in FIG. 1 on a hard surface, wherein the projectile does not extend into the hard surface.

FIG. 1 depicts a front view of an exemplary projectile 1 for ammunition of the present invention. As shown in FIG. 1, exemplary projectile 1 has an outer geometry comprising several notches 2 extending in a longitudinal direction (i.e., axial direction). Notches 2 are present in a number equal to or greater than two and are desirably disposed in such a manner as to avoid an imbalance of the rotation of projectile 1 about its dissecting axis 3, which may cause a deviation of a flight path 9 such as shown in FIG. 3. In some embodiments, the number of notches 2 is desirably three. In other embodiments, the number of notches 2 is desirably four.

As further shown in FIG. 1, exemplary projectile 1 has a notch configuration that increases (i) an outer surface area of ogive end portion 5 of projectile 1, and (ii) a given length of an outer surface periphery extending along a line with in a plane normal to dissecting axis 3. In some embodiments, at least one side (i.e., first notch surface portion 4) of notch 2 is inclined relative to an outer surface 51 of ogive end portion 5, so that, with the appropriate dimensions, the notch 2 extends axially from ogive end portion 5 to a location 52 between ogive end portion 5 and a cylindrical portion 6 of projectile 1, being surrounded (i.e., completely surrounded) by outer surface 51 of ogive end portion 5, and not occupy cylindrical portion 6, which could negatively affect the caliber of the ammunition and the sealing required for propulsion of projectile 1 through a firearm.

Each notch 2 may comprise first notch surface portion 4 in combination with a second notch surface portion 7, such as spherical surface 7. Spherical surface 7 makes notch 2 structurally stronger so that when it hits a soft surface 8, it avoid the formation and propagation of cracks which decompose projectile 1 into small fragments.

In some embodiments, projectile 1 may be manufactured by injection molding a polymeric material (e.g., polyamide) filled with metal particles. In some embodiments, projectile 1 may be manufactured by sintering and/or machining with or without electrochemical coating. Desirably, in some embodiments, projectile 1 is manufactured with a base material that will not deform easily and decompose into fragments on a violent impact against a hard surface 15 to ensure that it remains a frangible projectile 1 by definition.

As shown in FIG. 3, in some embodiments of the present invention, projectile 1 approaches a hard surface 15 after a shot, making a trajectory 9 with a rotational movement 10 along axis 3 of projectile 1 so as to ensure stability during flight. On impact, energy of projectile 1 makes projectile 1 decompose into fragments 16, which are thrown in all directions producing only a small damaged area 17 on hard surface 15. The production of such fragments 16 prevents projectile 1 from ricocheting uncontrollably and reaching an unintended target.

Figure 4:
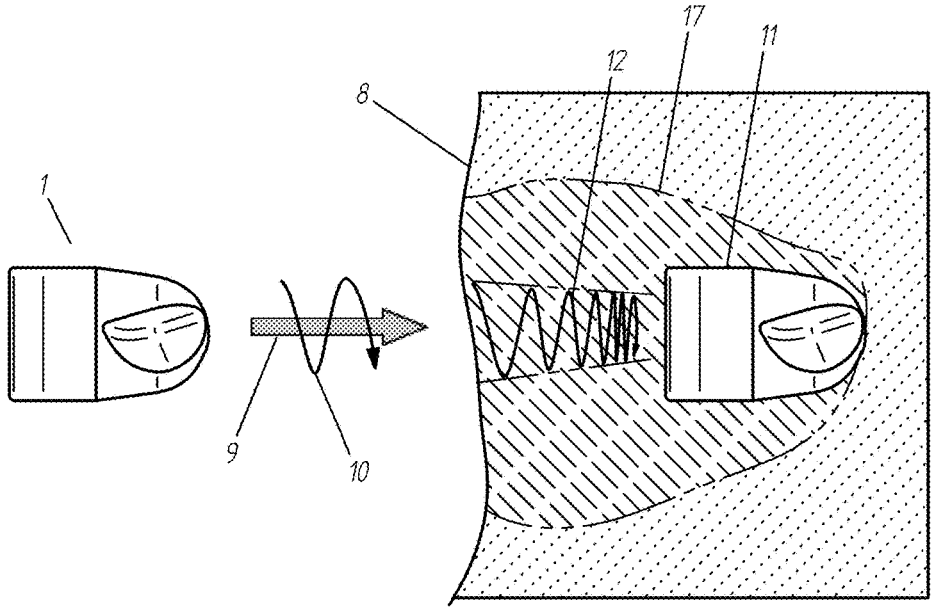
FIG. 4 depicts another effect of the impact of the exemplary projectile shown in FIG. 1 on a hard surface, wherein the projectile penetrates into the hard surface.

As shown in FIG. 4, in some embodiments of the present invention, projectile 1 approaches a soft surface 8 upon firing, also following a path 9 and, at the same time, a rotational movement 10 around axis 3 of projectile 1 to ensure stability during flight. Upon impact on the target comprised of soft surface 8, penetration 11 occurs due to the projectile velocity and damping 12 of the rotational movement 11. Damping 12 is due to the effect of the soft surface 8 resistance cut by notches 2 of projectile 1 as if it was a drill. Damping 12 will cause an increase in resistance of projectile 1 and an increase in the amount of damaged tissue, increasing the amount of transmitted energy (i.e., kinetic and rotational) and the size of the damaged area 17 in the form of a temporary cavity.

Figure 5A:
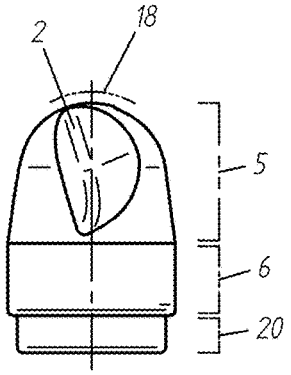
FIG. 5A depicts a front view of another exemplary projectile for ammunition of the present invention.
Figure 5B:
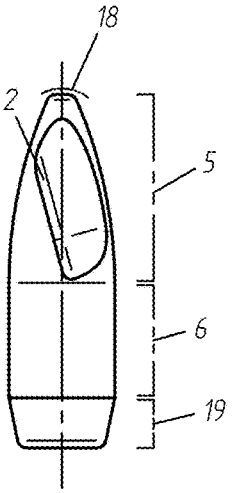
FIG. 5B depicts a front view of yet another exemplary projectile for ammunition of the present invention.
Figure 6A:
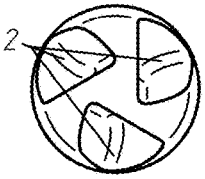
FIG. 6A depicts a top view of the exemplary projectile shown in FIG. 5A.
Figure 6B:
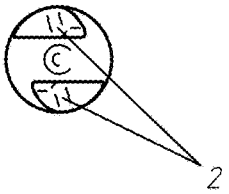
FIG. 6B depicts a top view of the exemplary projectile shown in FIG. 5B.

In some embodiments, the bottom 61 of projectile 1, opposite the tip 18 in the longitudinal direction of axis 3, may contain a conical geometry 19, also called "boat tail," as shown in FIG. 5B, to increase the aerodynamics of projectile 1. In other embodiments, the bottom 61 of projectile 1 may have a double diameter 20, as shown in FIG. 5A, to fit the mounting of, for example, a polymer or composite casing.

The projectiles and ammunition of the present invention and methods of making and using projectiles and ammunition of the present invention are further described in the embodiments below.

Projectile and Ammunition Embodiments

1. A projectile 1 for ammunition, said projectile 1 comprising an outer profile geometry on an ogive-shaped impact end portion 5 thereof, said outer profile geometry comprising two or more notches 2 extending in at least one of (i) an axial, (ii) parallel or (iii) slightly inclined orientation relative to a dissecting axis 3 extending longitudinally through said impact end portion 5 of said projectile 1, wherein each notch 2 (a) comprises notch surface portions 4,7 so as to increase (i) an overall outer surface area of said ogive end portion 5 of projectile 1, and (ii) a given length of an outer surface periphery $S_p$ extending along a line within a plane normal to said dissecting axis 3, and (b) is surrounded by an outer side surface 51 of said ogive-shaped impact end portion 5 of said projectile 1. In other words, the presence of the two or more notches 2 increases a length of an outer surface periphery $S_p$ extending along a line within a plane normal to said dissecting axis 3 relative to the same outer surface periphery $S_p$ extending within the same plane normal to said dissecting axis 3 when a notch is not present.

2. A projectile 1 for ammunition, said projectile 1 comprising: an outer surface profile extending along an ogive-shaped impact end portion 5 of said projectile 1; and two or more notches 2 extending axially along said outer surface profile, wherein each notch 2: (a) comprises notch surface portions 4,7 so as to increase (i) an overall outer surface area of said ogive end portion 5 of projectile 1, and (ii) a given length of an outer surface periphery $S_p$ extending along a line within a plane normal to said dissecting axis 3, (b) is surrounded by an outer side surface 51 of said ogive-shaped impact end portion 5 of said projectile 1; (c) comprises a notch dissecting line $L_{nd}$ extending axially through and being centrally located within said notch 2 (i.e., along a longitudinally length of notch 2), (d) comprises notch outer periphery points $P_L$,$P_R$ along an outer notch perimeter 21 on opposite sides of said notch dissecting line $L_{nd}$, and (e) comprises right and left-hand line portions $\mathbf{22}_L$, $\mathbf{22}_R$ of a normal line extending from said notch dissecting line $L_{nd}$ to each notch outer periphery point $P_L$,$P_R$, wherein each of said right and left-hand line portions $\mathbf{22}_L$, $\mathbf{22}_R$ (i) increases in length along at least a first portion of said notch dissecting line $L_{nd}$ and subsequently (ii) decreases in length along at least a second portion of said notch dissecting line $L_{nd}$ extending between an uppermost periphery portion 23 of said notch 2 and a lowermost periphery portion 24 of said notch 2.

3. A projectile 1 for ammunition, said projectile 1 comprising: an outer surface profile extending along an ogive-shaped impact end portion 5 of said projectile 1; and two or more notches 2 extending axially along said outer surface profile, wherein each notch 2: (a) comprises notch surface portions 4,7 so as to increase (i) an overall outer surface area of said ogive end portion 5 of projectile 1, and (ii) a given length of an outer surface periphery $S_p$ extending along a line within a plane normal to said dissecting axis 3, (b) is surrounded by an outer side surface 51 of said ogive-shaped impact end portion 5 of said projectile 1; (c) comprises a notch depth dissecting line $L_{dd}$ extending axially through and being located along a path that represents a largest depth within said notch 2, (d) comprises notch outer periphery points $P_L$,$P_R$ along an outer notch perimeter 21 on opposite sides of said notch depth dissecting line $L_{dd}$, and (e) comprises right and left-hand line portions $\mathbf{25}_L$,$\mathbf{25}_R$ of a normal line extending from said notch depth dissecting line $L_{dd}$ to each notch outer periphery point $P_L$,$P_R$, wherein each of said right and left-hand line portions $\mathbf{25}_L$,$\mathbf{25}_R$ (i) increases in length along at least a first portion of said notch depth dissecting line $L_{dd}$ and subsequently (ii) decreases in length along at least a second portion of said notch depth dissecting line $L_{dd}$ extending between an uppermost periphery portion 23 of said notch 2 and a lowermost periphery portion 24 of said notch 2.

4. The projectile 1 of embodiment 2 or 3, wherein each notch 2 is surrounded by an outer side surface 51 of said ogive-shaped impact end portion 5 of said projectile 1.

5. The projectile 1 of any one of embodiments 1 and 3 to 4, wherein each notch 2 comprises: a notch dissecting line $L_{nd}$ extending axially through and being centrally located within said notch 2, (d) comprises notch outer periphery points $P_L$,$P_R$ along an outer notch perimeter 21 on opposite sides of said notch dissecting line $L_{nd}$, and (e) comprises right and left-hand line portions $\mathbf{22}_L$, $\mathbf{22}_R$ of a normal line extending from said notch dissecting line $L_{nd}$ to each notch outer periphery point $P_L$,$P_R$, wherein each of said right and left-hand line portions $\mathbf{22}_L$, $\mathbf{22}_R$ (i) increases in length along at least a first portion of said notch dissecting line $L_{nd}$ and subsequently (ii) decreases in length along at least a second portion of said notch dissecting line $L_{nd}$ extending between an uppermost periphery portion 23 of said notch 2 and a lowermost periphery portion 24 of said notch 2.

6. The projectile of any one of embodiments 1 to 2 and 4 to 5, wherein each notch comprises: a notch depth dissecting line $L_{dd}$ extending axially through and being located along a path that represents a largest depth within said notch 2, (d) comprises notch outer periphery points $P_L$,$P_R$ along an outer notch perimeter 21 on opposite sides of said notch depth dissecting line $L_{dd}$, and (e) comprises right and left-hand line portions $\mathbf{25}_L$,$\mathbf{25}_R$ of a normal line extending from said notch depth dissecting line $L_{dd}$ to each notch outer periphery point $P_L$,$P_R$, wherein each of said right and left-hand line portions $\mathbf{25}_L$,$\mathbf{25}_R$ (i) increases in length along at least a first portion of said notch depth dissecting line $L_{dd}$ and subsequently (ii) decreases in length along at least a second portion of said notch depth dissecting line $L_{dd}$ extending between an uppermost periphery portion 23 of said notch 2 and a lowermost periphery portion 24 of said notch 2.

7. The projectile 1 of any one of embodiments 1 to 6, wherein each notch 2 is parallel relative to one another.

8. The projectile 1 of any one of embodiments 1 to 7, wherein each notch 2 has a slightly inclined orientation relative to said dissecting axis 3. As used herein, the term "slightly inclined" relative to dissecting axis 3 is used to describe an angle A, as shown on FIG. 1, which represents the angle between dissecting axis 3 and a direction of a portion of notch depth dissecting line $L_{dd}$ entering a given notch 2 at uppermost periphery portion 23 of notch 2.

9. The projectile 1 of any one of embodiments 1 to 8, wherein each notch 2 has a slightly inclined orientation relative to said dissecting axis 3, with each notch 2 being oriented at an angle A of greater than zero up to about 45° relative to said dissecting axis 3.

10. The projectile 1 of any one of embodiments 1 to 9, wherein each notch 2 has a slightly inclined orientation relative to said dissecting axis 3, with each notch 2 being oriented at an angle A of from about 15° to about 30° relative to said dissecting axis 3.

11. The projectile 1 of any one of embodiments 2 to 10, wherein said notch dissecting line $L_{nd}$ curves as said notch dissecting line $L_{nd}$ moves from said uppermost periphery portion 23 of said notch 2 to said lowermost periphery portion 24 of said notch 2.

12. The projectile 1 of any one of embodiments 3 to 11, wherein said notch depth dissecting line $L_{dd}$ curves as said notch depth dissecting line $L_{dd}$ moves from said uppermost periphery portion 23 of said notch 2 to said lowermost periphery portion 24 of said notch 2.

13. The projectile 1 of embodiment 12, wherein said notch depth dissecting line $L_{dd}$ has a J-shape or reverse J-shape as said notch depth dissecting line $L_{dd}$ moves from said uppermost periphery portion 23 of said notch 2 to said lowermost periphery portion 24 of said notch 2.

Figure 7A:
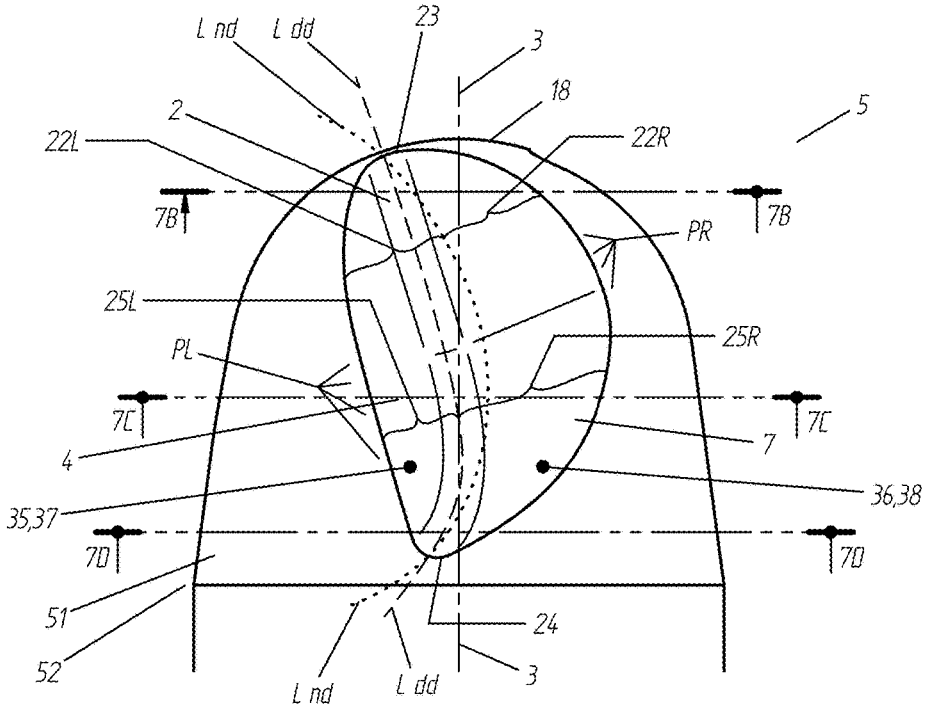
FIG. 7A depicts an exploded view of the exemplary notch of the exemplary projectile shown in FIG. 1.
Figure 7B:
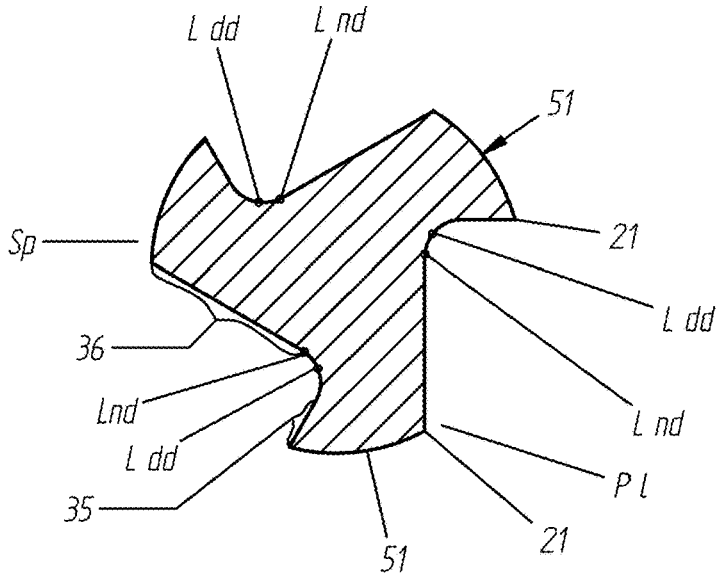
FIG. 7B depicts a partial cross-sectional view of the exemplary notch shown in FIG. 7A as viewed along line 7B-7B.
Figure 7C:
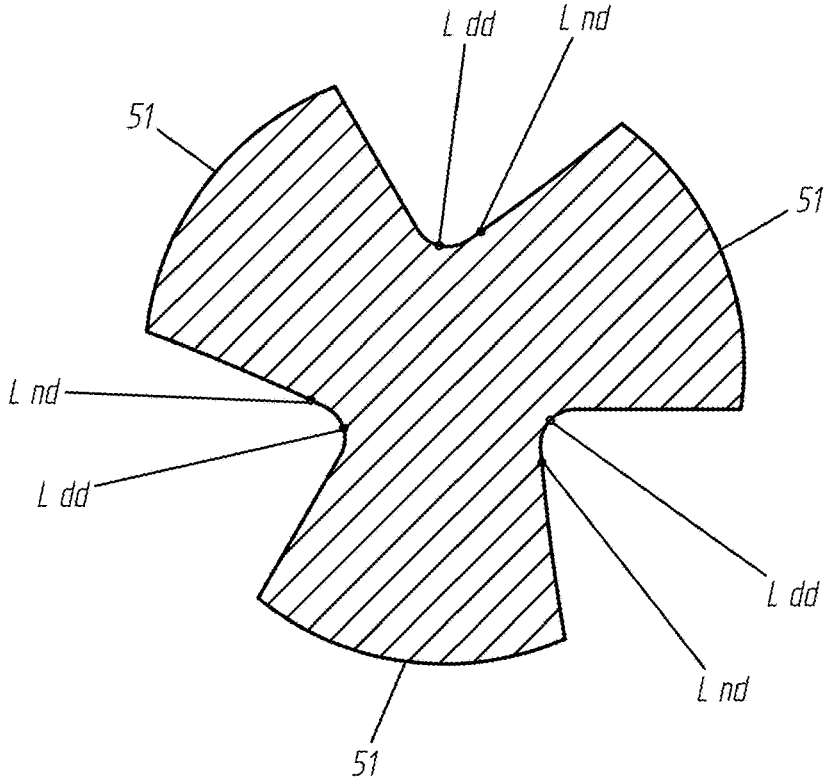
FIG. 7C depicts a partial cross-sectional view of the exemplary notch shown in FIG. 7A as viewed along line 7C-7C.
Figure 7D:
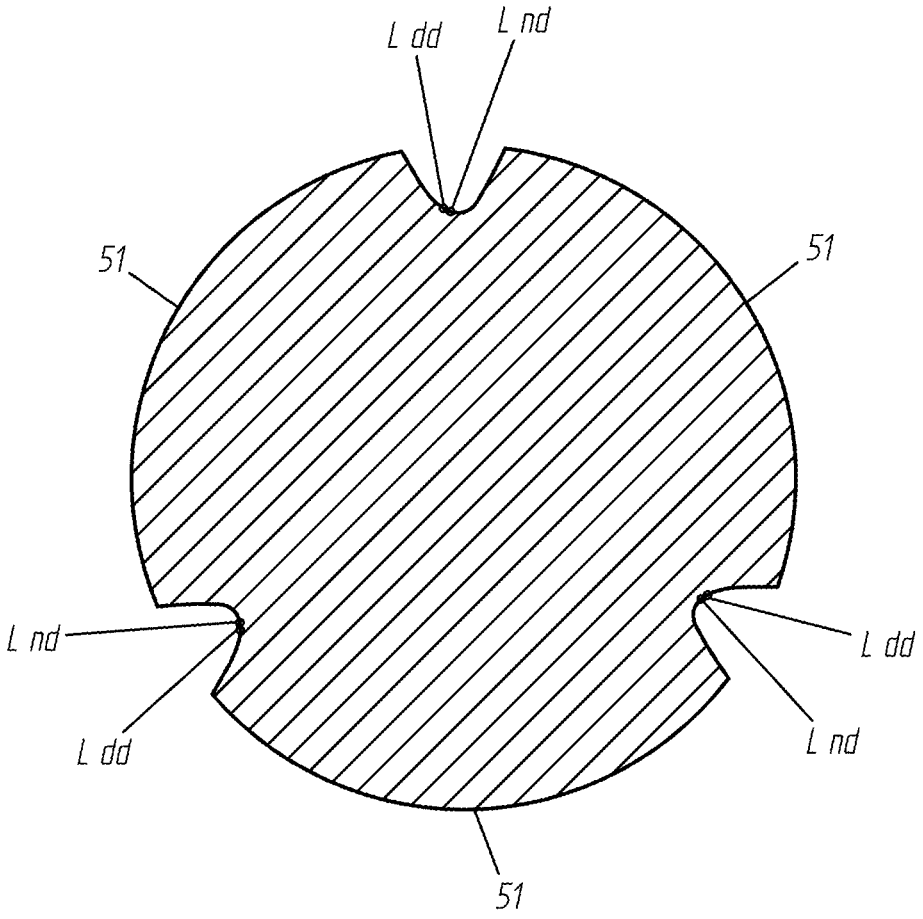
FIG. 7D depicts a partial cross-sectional view of the exemplary notch shown in FIG. 7A as viewed along line 7D-7D.

14. The projectile 1 of any one of embodiments 3 to 13, wherein each notch 2 has (i) a first notch surface area 35 and a first depth grade 37 on one side of said notch depth dissecting line $L_{dd}$ (i.e., the left side of $L_{dd}$ shown in FIG. 7A) and (ii) a second notch surface area 36 and a second depth grade 38 on an opposite side of said notch depth dissecting line $L_{dd}$ (i.e., the right side of $L_{dd}$ shown in FIG. 7A), said first notch surface area 35 being smaller than said second notch surface area 37 and said first depth grade 36 being greater than said second depth grade 38.

15. The projectile 1 of any one of embodiments 1 to 14, wherein said notch surface portions 4,7 comprise one or more cylindrically-shaped or spherically-shaped notch surface portions.

16. The projectile 1 of any one of embodiments 1 to 15, wherein said two or more notches 2 comprise three or more notches 2.

17. The projectile 1 of any one of embodiments 1 to 16, wherein said two or more notches 2 comprise three notches 2 equally spaced from one another.

18. The projectile 1 of any one of embodiments 1 to 16, wherein said two or more notches 2 comprise four notches 2 equally spaced from one another.

Figure 2:
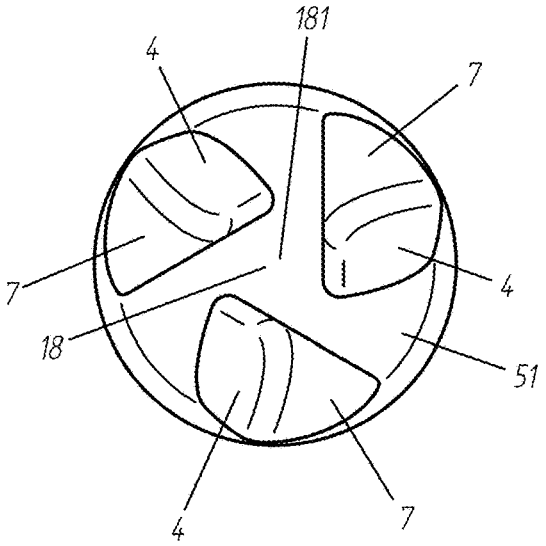
FIG. 2 depicts a top view of the exemplary projectile shown in FIG. 1.

19. The projectile 1 of any one of embodiments 1 to 18, wherein said ogive-shaped impact end portion 5 extends from a projectile tip end 18 to a transition periphery 52 along said projectile 1, and said projectile 1 further comprises a cylindrical portion 6 extending from said transition periphery 52 to an opposite end 61 of said projectile 1. As shown in FIG. 2, point 181 on projectile tip end 18, at which point dissecting axis 3 extends therethrough, is free from any type of notch/indentation (e.g., free of a hollow point indentation). It should be noted that the projectiles of the present invention could have a hollow point indentation at point 181; however, desired projectiles of the present invention do not have a hollow point indentation (or any other indentation/notch) at point 181 as shown in FIG. 2.

20. The projectile 1 of any one of embodiments 1 to 19, wherein said ogive-shaped impact end portion 5 comprises a polymeric matrix material filled with metal particles. For example, a projectile may comprise a polymeric matrix material (e.g., polyamide) filled with copper or tungsten particles.

21. The projectile 1 of any one of embodiments 1 to 19, wherein said ogive-shaped impact end portion 5 comprises a metal.

22. The projectile 1 of any one of embodiments 1 to 19, wherein said ogive-shaped impact end portion 5 consists of a metal.

23. The projectile 1 of embodiment 21 or 22, wherein said metal is selected from brass, silver, lead, lead alloy, copper plated lead alloy, copper, or stainless steel.

24. The projectile 1 of any one of embodiments 1 to 23, wherein an opposite end 61 of said projectile 1 has a truncated cone shape. See, for example, exemplary projectile 1 shown in FIG. 5B.

25. The projectile 1 of any one of embodiments 1 to 23, wherein an opposite end 61 of said projectile 1 has a reduced diameter cylindrical shape. See, for example, exemplary projectile 1 shown in FIG. 5A.

26. A projectile 1 according to any one of embodiments 1 to 25, said projectile 1 being produced by any one of: (i) injection molding a plastic material filled with metal particles, (ii) a sintering step, or (iii) a machining step.

27. A projectile 1 according to any one of embodiments 1 to 25, said projectile 1 being produced by a forming step, said forming step selected from any one or any combination of: (i) a molding step, (ii) a stamping step, (iii) a machining step, (iv) a pressure-applying step, and a striking step.

28. A composite or polymer casing comprising the projectile 1 of any one of embodiments 1 to 27 mounted therein.

29. A metal casing comprising the projectile 1 of any one of embodiments 1 to 27 mounted therein.

30. A plurality of composite or polymer casings, metal casings, or a combination thereof, wherein each casing within said plurality of casings comprises the projectile 1 of any one of embodiments 1 to 27.

31. A box of composite casings comprising: one or more composite or polymer or metal casings comprises the projectile 1 of any one of embodiments 1 to 27; a cartridge-holding device; and an outer box sized to contain said cartridge-holding device with one or more composite casings positioned therein.

Methods of Making Projectiles and Ammunition Embodiments

32. A method of making the projectile 1 for ammunition of any one of embodiments 1 to 20 and 24 to 26, said method comprising: injection molding a plastic material filled with metal particles, sintering or machining.

33. A method of making the projectile 1 for ammunition of any one of embodiments 1 to 19, 21 to 25 and 27, said method comprising: forming said projectile 1, said forming step selected from any one or any combination of: (i) a molding step, (ii) a stamping step, (iii) a machining step, (iv) a pressure-applying step, and a striking step.

34. The method of embodiment 33, wherein said forming step is a stamping step.

35. The method of embodiment 33, wherein said forming step is a pressure-applying step.

36. The method of embodiment 33, wherein said forming step is a molding step.

Methods of Using Projectiles and Ammunition Embodiments

37. A method of using the projectile for ammunition of any one of embodiments 1 to 27, said method comprising: positioning a composite or polymer or metal casing comprising the projectile 1 in a chamber of a projectile-firing weapon; and firing the weapon.

38. A method of using the projectile 1 for ammunition of any one of embodiments 1 to 27, said method comprising: positioning the projectile 1 in a chamber of a projectile-firing compressed air weapon (e.g., an air gun); and firing the weapon.

39. The method of embodiment 37 or 38, wherein the projectile-firing weapon or projectile-firing compressed air weapon comprises a pistol or any other type of hand gun.

40. The method of embodiment 37 or 38, wherein the projectile-firing weapon or projectile-firing compressed air weapon comprises a rifle or any other type of long gun.

41. The method of embodiment 37 or 38, wherein the projectile-firing weapon or projectile-firing compressed air weapon comprises any type of machine or submachine gun.

The present invention is further illustrated by the following examples, which are not to be construed in any way as imposing limitations upon the scope thereof. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

EXAMPLE 1

Preparation of Projectiles and Ammunition

Exemplary projectiles as shown in FIGS. 1-7D were prepared using various projectile-forming steps. In some cases, exemplary projectiles such as shown in FIGS. 1-7D were prepared by injection molding polymer resin, such as a polyamide filled with copper particles, to form 9 mm composite projectiles 1. In other cases, exemplary projectiles such as shown in FIGS. 1-7D were prepared by a stamping process so as to form metal projectiles 1 comprising copper or lead.

The resulting projectiles were incorporated into a metal casing or a composite casing, such as the composite casing disclosed in International Application Serial No.: PCT/US12/71395, filed on Dec. 12, 2013 and entitled "Polymer-Based Composite Casings and Ammunition Containing the Same, and Methods of Making and Using the Same", the subject matter of which is hereby incorporated herein by reference in its entirety.

The above procedure, or a variation thereof, was used to form ammunition suitable for use in a variety of commercially available rifles, pistols, machine and submachine guns, and air-guns (e.g., pistols and other hand guns, rifles, machine and submachine guns, etc.).

It should be understood that although the above-described projectiles, ammunition and/or methods are described as "comprising" one or more components or steps, the above-described projectiles, ammunition and/or methods may "comprise," "consists of," or "consist essentially of" the above-described components, features or steps of the projectiles, ammunition and/or methods. Consequently, where the present invention, or a portion thereof, has been described with an open-ended term such as "comprising," it should be readily understood that (unless otherwise stated) the description of the present invention, or the portion thereof, should also be interpreted to describe the present invention, or a portion thereof, using the terms "consisting essentially of" or "consisting of" or variations thereof as discussed below.

As used herein, the terms "comprises," "comprising," "includes," "including," "has," "having," "contains", "containing," "characterized by" or any other variation thereof, are intended to encompass a non-exclusive inclusion, subject to any limitation explicitly indicated otherwise, of the recited components. For example, a projectile, ammunition and/or method that "comprises" a list of elements (e.g., components, features, or steps) is not necessarily limited to only those elements (or components or steps), but may include other elements (or components or steps) not expressly listed or inherent to the projectile, ammunition and/or method.

As used herein, the transitional phrases "consists of" and "consisting of" exclude any element, step, or component not specified. For example, "consists of" or "consisting of" used in a claim would limit the claim to the components, materials or steps specifically recited in the claim except for impurities ordinarily associated therewith (i.e., impurities within a given component). When the phrase "consists of" or "consisting of" appears in a clause of the body of a claim, rather than immediately following the preamble, the phrase "consists of" or "consisting of" limits only the elements (or components or steps) set forth in that clause; other elements (or components) are not excluded from the claim as a whole.

As used herein, the transitional phrases "consists essentially of" and "consisting essentially of" are used to define a projectile, ammunition and/or method that includes materials, steps, features, components, or elements, in addition to those literally disclosed, provided that these additional materials, steps, features, components, or elements do not materially affect the basic and novel characteristic(s) of the claimed invention. The term "consisting essentially of" occupies a middle ground between "comprising" and "consisting of".

Further, it should be understood that the herein-described projectiles, ammunition and/or methods may comprise, consist essentially of, or consist of any of the herein-described components, features and steps, as shown in the figures with or without any feature(s) not shown in the figures. In other words, in some embodiments, the projectiles, ammunition and/or methods of the present invention do not have any additional features other than those shown in the figures, and such additional features, not shown in the figures, are specifically excluded from the projectiles, ammunition and/or methods. In other embodiments, the projectiles, ammunition and/or methods of the present invention do have one or more additional features that are not shown in the figures.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A projectile (1) for ammunition, said projectile (1) comprising an outer profile geometry on an impact end portion (5) thereof, said outer profile geometry comprising three or more notches (2) equally spaced from one another and extending in an axial orientation relative to a dissecting axis (3) extending longitudinally through said impact end portion (5) of said projectile (1), wherein each of said three or more notches (2) (a) comprises notch surface portions (4,7) so as to increase (i) an overall outer surface area of said impact end portion (5) of projectile (1), and (ii) a given length of an outer surface periphery ($S_p$) extending along a line within a plane normal to said dissecting axis (3), (b) has a notch depth dissecting line ($L_{dd}$) extending axially through and being located along a path that represents a largest depth within said notch (2), and (c) extends a length substantially equal to a distance along said dissecting axis (3) from a projectile tip end (18) of said projectile (1) to a transition periphery (52) along said projectile (1), said transition periphery (52) separating said impact end portion (5) of said projectile (1) from a cylindrical portion (6) extending from said transition periphery (52) towards an opposite end (61) of said projectile (1), and wherein each of said three or more notches (2) further comprises:

a notch dissecting line ($L_{nd}$) extending axially through and being centrally located within said notch (2), notch outer periphery points ($P_L$,$P_R$) along an outer notch perimeter (21) on opposite sides of said notch dissecting line ($L_{nd}$), and right and left-hand line portions (22$_L$,22$_R$) of a normal line extending from said notch dissecting line ($L_{nd}$) to each notch outer periphery point ($P_L$,$P_R$), wherein each of said right and left-hand line portions (22$_L$, 22$_R$) (i) increases in length along at least a first portion of said notch dissecting line ($L_{nd}$) and subsequently (ii) decreases in length along at least a second portion of said notch dissecting line ($L_{nd}$)

extending between an uppermost periphery portion (23) of said notch (2) and a lowermost periphery portion (24) of said notch (2).

2. The projectile (1) of claim 1, wherein said impact end portion (5) comprises a metal, wherein said metal is selected from brass, silver, lead, lead alloy, copper plated lead alloy, copper, or stainless steel.

3. The projectile (1) of claim 1, wherein said notch depth dissecting line ($L_{dd}$) of each notch (2) curves as said notch depth dissecting line ($L_{dd}$) moves from said uppermost periphery portion (23) of each notch (2) to said lowermost periphery portion (24) of each notch (2).

4. The projectile (1) of claim 3, wherein said notch depth dissecting line ($L_{dd}$) of each notch (2) has a J-shape or reverse J-shape as said notch depth dissecting line ($L_{dd}$) moves from said uppermost periphery portion (23) of each notch (2) to said lowermost periphery portion (24) of each notch (2).

5. The projectile (1) of claim 1, wherein said notch surface portions (4,7) comprise one or more cylindrically-shaped notch surface portions (4,7).

6. The projectile (1) of claim 1, wherein said opposite end (61) of said projectile (1) has a truncated cone shape or a reduced diameter cylindrical shape.

7. The projectile (1) of claim 1, wherein said projectile (1) comprises three notches (2).

8. The projectile (1) of claim 1, wherein said projectile (1) comprises four notches (2).

9. A composite or polymer casing comprising the projectile (1) of claim 8 mounted therein.

10. A metal casing comprising the projectile of claim 8 mounted therein.

11. A box of composite casings comprising:

one or more composite or polymer or metal casings in combination with the projectile of claim 8;

a cartridge-holding device; and an outer box sized to contain said cartridge-holding device with the one or more composite or polymer or metal casings in combination with said projectile positioned therein.

12. A method of making the projectile of claim 8, said method comprising:

molding or machining metal to form the projectile.

13. A method of using the projectile (1) of claim 8, said method comprising:

positioning a composite or polymer or metal casing comprising the projectile (1) in a chamber of a projectile-firing weapon; and firing the weapon.

14. A method of using the projectile (1) of claim 8, said method comprising:

positioning the projectile (1) in a chamber of a projectile-firing compressed air weapon; and firing the weapon.

15. A projectile (1) for ammunition, said projectile (1) comprising an outer profile geometry on an impact end portion (5) thereof, said outer profile geometry comprising three or four notches (2) equally spaced from one another and extending in an axial orientation relative to a dissecting axis (3) extending longitudinally through said impact end portion (5) of said projectile (1), wherein each of said three or four notches (2) (a) comprises notch surface portions (4,7) so as to increase (i) an overall outer surface area of said impact end portion (5) of projectile (1), and (ii) a given length of an outer surface periphery ($S_p$) extending along a line within a plane normal to said dissecting axis (3), (b) has a notch depth dissecting line ($L_{dd}$) extending axially through and being located along a path that represents a largest depth within said notch (2), wherein said notch depth dissecting line ($L_{dd}$) has a J-shape or reverse J-shape as said notch depth dissecting line ($L_{dd}$) moves from an uppermost periphery portion of said notch to a lowermost periphery portion of said notch, and (c) extends a length substantially equal to a distance along said dissecting axis (3) from a projectile tip end (18) of said projectile (1) to a transition periphery (52) along said projectile (1), said transition periphery (52) separating said impact end portion (5) of said projectile (1) from a cylindrical portion (6) extending from said transition periphery (52) towards an opposite end (61) of said projectile (1), wherein said impact end portion (5) comprises a metal, wherein said metal is selected from brass, silver, lead, lead alloy, copper plated lead alloy, copper, or stainless steel.

16. A method of using the projectile (1) of claim 15, said method comprising:

positioning a composite or polymer or metal casing comprising the projectile (1) in a chamber of a projectile-firing weapon; and firing the weapon.

17. The projectile (1) of claim 15, wherein each of said three or four notches (2) further comprises:

a notch dissecting line ($L_{nd}$) extending axially through and being centrally located within said notch (2), notch outer periphery points ($P_L$,$P_R$) along an outer notch perimeter (21) on opposite sides of said notch dissecting line ($L_{nd}$), and right and left-hand line portions ($\mathbf{22}_L$,$\mathbf{22}_R$) of a normal line extending from said notch dissecting line ($L_{nd}$) to each notch outer periphery point ($P_L$,$P_R$), wherein each of said right and left-hand line portions ($\mathbf{22}_L$,$\mathbf{22}_R$) (i) increases in length along at least a first portion of said notch dissecting line ($L_{nd}$) and subsequently (ii) decreases in length along at least a second portion of said notch dissecting line ($L_{nd}$) extending between an uppermost periphery portion (23) of said notch (2) and a lowermost periphery portion (24) of said notch (2).

18. A projectile (1) for ammunition, said projectile (1) comprising an outer profile geometry on an impact end portion (5) thereof, said outer profile geometry comprising three or more notches (2) equally spaced from one another and extending in an axial orientation relative to a dissecting axis (3) extending longitudinally through said impact end portion (5) of said projectile (1), wherein each of said three or more notches (2) (a) comprises notch surface portions (4,7) so as to increase (i) an overall outer surface area of said impact end portion (5) of projectile (1), and (ii) a given length of an outer surface periphery ($S_p$) extending along a line within a plane normal to said dissecting axis (3), (b) has a notch depth dissecting line (Lad) extending axially through and being located along a path that represents a largest depth within said notch (2), (c) extends a length substantially equal to a distance along said dissecting axis (3) from a projectile tip end (18) of said projectile (1) to a transition periphery (52) along said projectile (1), said transition periphery (52) separating said impact end portion (5) of said projectile (1) from a cylindrical portion (6) extending from said transition periphery (52) towards an opposite end (61) of said projectile (1), and (d) comprises (i) a notch dissecting line ($L_{nd}$) extending axially through and being centrally located within said notch (2), (ii) notch outer periphery points ($P_L$,$P_R$) along an outer notch perimeter (21) on opposite sides of said notch dissecting line (La), and (iii) right and left-hand line portions ($\mathbf{22}_L$,$\mathbf{22}_R$) of a normal line extending from said notch dissecting line ($L_{nd}$) to each notch outer periphery point ($P_L$, $P_R$), wherein each of said right and left-hand line portions (22$_L$,22$_R$) (a) increases in length along at least a first portion of said notch dissecting line ($L_{nd}$) and subsequently (b) decreases in length along at least a second portion of said notch dissecting line ($L_{nd}$) extending between an uppermost periphery portion (23) of said notch (2) and a lowermost periphery portion (24) of said notch (2).

19. The projectile (1) of claim 18, wherein said opposite end (61) of said projectile (1) has a reduced diameter cylindrical shape.

20. The projectile (1) of claim 19, wherein said projectile (1) further comprises a shelf connecting said cylindrical portion (6) and said reduced diameter cylindrical shape of said opposite end (61), said shelf extending along an outer periphery of said projectile (1).

* * * * *